United States Patent [19]

Juckniess et al.

[11] 4,118,291

[45] Oct. 3, 1978

[54] METHOD OF ELECTROWINNING TITANIUM

[75] Inventors: Paul R. Juckniess; David R. Johnson, both of Midland, Mich.

[73] Assignee: The Dow Chemical Company, Midland, Mich.

[21] Appl. No.: 722,850

[22] Filed: Sep. 13, 1976

Related U.S. Application Data

[63] Continuation-in-part of Ser. No. 517,569, Oct. 24, 1974, abandoned.

[51] Int. Cl.[2] ..... C25C 3/28; C25C 7/04

[52] U.S. Cl. ..... 204/64 T; 204/295

[58] Field of Search ..... 204/64 T, 295

[56] References Cited

U.S. PATENT DOCUMENTS

| | | | |
|---|---|---|---|
| 2,789,943 | 4/1957 | Kittelberger | 204/247 X |
| 3,098,802 | 7/1963 | Beer | 204/295 X |

FOREIGN PATENT DOCUMENTS

| | | | |
|---|---|---|---|
| 4,613,803 | 4/1971 | Japan | 204/64 T |
| 678,807 | 9/1952 | United Kingdom | 204/64 T |

*Primary Examiner*—John H. Mack
*Assistant Examiner*—D. R. Valentine
*Attorney, Agent, or Firm*—Robert W. Selby

[57] ABSTRACT

A method to electrolytically produce metallic titanium from compounds thereof. The method includes first positioning a foraminous metallic diaphragm with a diaphragm coefficient of greater than zero to about 0.5 when the coefficient of flow is about 0.1 to about 25 in an electrolytic cell. The cell further includes an anode spaced apart from a cathode and a titanium compound feed means by the diaphragm. A feed means is combined with the cathode compartment to supply a titanium compound to a molten salt electrolyte in the cathode compartment. The apparatus is preferably sealed from the atmosphere to avoid contamination of the bath and metal product with certain atmospheric gases. An ionizable titanium compound is subsequently introduced into the electrolyte and an electromotive force impressed between the anode and the cathode to thereby deposite metallic titanium on the cathode.

37 Claims, 4 Drawing Figures

METHOD OF ELECTROWINNING TITANIUM

CROSS REFERENCE TO RELATED APPLICATION

This a continuation-in-part of a prior application Ser. No. 517,569 filed Oct. 24, 1974, now abandoned.

BACKGROUND OF THE INVENTION

This invention relates to the production of titanium and more in particular to a method to electrolytically form titanium from a titanium salt.

Metals, such as titanium, have previously been produced from compounds thereof, for example, titanium tetrachloride, by electrolytic means as described in U.S. Pat. Nos. 2,789,943; 2,943,032; and 3,082,159. Generally, the titanium tetrachloride is introduced into a molten alkali or alkaline earth metal salt bath through appropriate means and electrolytically disassociated to plate metallic titanium on a cathode and to release elemental chlorine at an anode. Various means have been employed to separate the anode from the cathode in the titanium-bearing electrolytic cells.

A physical barrier, such as a diaphragm, positioned between the anode and cathode compartments is necessary to prevent an excessive flow of titanium ions from the cathode compartment into the anode compartment. If such an excessive ion flow occurs, titanium ions would be oxidized to titanium tetrachloride thereby reducing the cell efficiency. The diaphragm should also permit passage of chloride ions and a fused salt bath between the anode and the cathode compartments.

The diaphragm of U.S. Pat. No. 2,789,943 consisted of a perforate, electrically conductive metallic structure which, when in use, was interchangeably an anode or a cathode. The diaphragm was made a cathode to cause deposition of metallic titanium into the pores thereof and reduce the porosity of the diaphragm. The electrical polarity was reversed, making the diaphragm an anode to remove titanium therefrom, when the diaphragm became excessively impervious and reduced the electrolytic cell efficiency. Such a diaphragm of variable porosity is operable; however, it would be more desirable to have a diaphragm which would not necessitate constant monitoring and frequent metal plating thereon and etching therefrom.

Leone et al., Use of Composite Diaphragms in Electrowinning of Titanium, Bureau of Mines Report RI 7648 (1972) and Leone et al., High-Purity Titanium Electrowon from Titanium Tetrachloride, J. of Metals 18 (March 1967) describe porous, metal screen-ceramic composite diaphragms positioned between anodes and cathodes for use in the electrowinning of titanium. The metal screen-ceramic composite is more costly and has a lower strength than is desired for production operations.

The electrolytic cells of the prior art are operable; however, the barrier or diaphragm between the anode and cathode chambers has usually been deficient in strength characteristics needed for production-type electrolytic equipment or required continuous and careful regulation of the porosity during operation of the cell. An improved method of operating an electrolytic cell for the electrowinning of titanium using a diaphragm with adequate physical properties and a constant porosity, which need not be regulated during operation, is desired.

SUMMARY OF THE INVENTION

The method of this invention includes feeding a titanium compound into a cathode compartment of an electrolytic cell. The cell comprises, in combination, a body adapted to contain a fused salt bath and to separate the bath from the ambient atmosphere. An anode compartment and a deposition cathode compartment are suitably positioned within the body in a spaced apart relationship to each other. The anode and cathode compartments are spaced apart by at least one foraminous metallic diaphragm adapted to be electrically insulated from sources of electrical energy exterior to the anode and cathode compartments and at least partially immersed within the fused salt bath during operation of the cell. The diaphragm is characterized by a diaphragm coefficient ($C_d$) within the range of from greater than zero up to about 0.5 when the coefficient of flow ($C_f$) is within the range of from about 0.1 to about 25. Herein $C_d$ is defined as being in inches and $C_f$ as being in $\sqrt{\text{inches}}$ per liter per minute per 30 square inches of diaphragm surface. The diaphragm coefficient can be determined by the hereinafter described procedure and is represented by the formula:

$$C_d = \frac{V_{d+s}/I_{d+s} - V_s/I_s}{V_s/I_s} \times 0.75$$

$V_{d+s}$ is the voltage (volts) in an aqueous 0.1 molar sodium chloride solution of a test cell as determined by calomel measuring electrodes communicating with the solution in the test cell by salt bridges with orifices to such salt bridges spaced 0.75 inch apart between silver-silver chloride primary electrodes, spaced one inch apart, and also spaced apart by that portion of the diaphragm positioned between the primary electrodes during operation $I_{d+s}$ is an electrical current of 0.002 amperes maintained between the primary electrodes in the solution with a diaphragm positioned as for $V_{d+s}$ $V_s$ is the voltage (volts) as determined for $V_{d+s}$, but without the diaphragm $I_s$ is the electrical current of 0.002 amperes maintained between the primary electrodes in the solution as determined for $I_{d+s}$, but without the diaphragm.

The coefficient of flow is represented by the formula:

$$C_f = \sqrt{h/F}$$

where:

$h$ is a pressure head of 10 inches of water at about 75° F. as measured upwardly from the centerline of a circular diaphragm portion, with a 30 square inch area on a single surface of such diaphragm portion, where a water flow measurement through the diaphragm is obtained, and $F$ is the volumetric water flow rate through the diaphragm portion in liters per minute at about 75° F.

The diaphragm configuration or size may necessitate that a diaphragm portion smaller or larger than the above 30 square inch portion be used for measuring the water flow. When such a smaller or larger diaphragm portion is used, F should be calculated to represent the water flow through the 30 square inch area described above.

Stated in a slightly different manner, the above formula for determining the diaphragm coefficient is believed to be basically the combined resistance of the diaphragm plus the solution in the test cell minus the resistance of the solution divided by the resistance of the solution. The number resulting from this calculation represents the electrical resistance of the diaphragm in terms of the electrical resistance of 0.75 inch of solution, since the salt bridges are spaced 0.75 inch apart. To convert the calculated number to a term expressed in inches of solution, the calculated number is multiplied by 0.75. The diaphragm coefficient represents the electrical resistance of the diaphragm in the test cell. The diaphragm coefficient is also believed to be a measure of the resistance of the solution contained in the pores of the diaphragm.

The electrolytic cell further includes at least one anode, adapted to be at least partially immersed in the bath, positioned within the anode compartment. At least one deposition cathode adapted to be at least partially immersed in the bath is simultaneously positioned within the cathode compartment. A suitable means to remove gases formed at the anode is in combination with the anode compartment. At least one feed means adapted to provide a titanium containing feed material, such as ions of an ionizable titanium compound, to the bath and a suitable means to remove metallic titanium deposited at the cathode are in combination with the cathode compartment. Additionally, a means adapted to provide sufficient electrical energy to the anode and the deposition cathode to reduce the titanium ions from a higher to a lower valence state and to deposit titanium metal at the deposition cathode is suitably connected to the anode and the cathode.

The titanium compound fed into the cathode compartment is characterized as being at least partially and preferably substantially entirely ionizable in the fused salt bath. The titanium ions are reduced from a higher to a lower valance state at the cathode. A gas, such as the halogen chlorine, is released at the anode. The gas and metallic titanium are removed from the cell by appropriate means.

DESCRIPTION OF THE DRAWING

The accompanying drawing further illustrates the invention.

Identical numerals, distinguished by a letter suffix, within the several figures represent parts having a similar function within the different embodiments.

DESCRIPTION OF THE PREFERRED EMBODIMENTS

Figure 1:
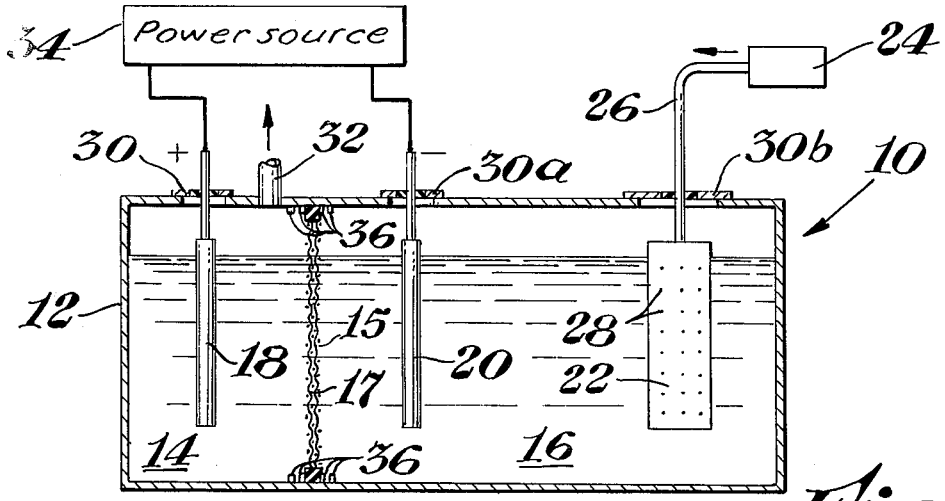
FIG. 1 is a cross-sectional view of an electrolytic cell for the production of solid titanium.

In FIG. 1 is depicted electrolytic equipment 10 suited to electrowin titanium in a fused salt bath from compounds of titanium.

The fused or molten salt is characterized as being a solvent for the titanium compound. Such salts or mixtures thereof can be, for example, NaCl, LiCl-KCl, LiCl-KCl-NaCl, and LiCl-KCl-$CaCl_2$. When titanium is recovered from titanium tetrachloride, the fused salt bath desirably contains a mixture of alkali or alkaline earth metal halides, preferably lithium and potassium chlorides. A eutectic mixture of the salts employed in the bath is advantageous because of the low melting temperature of such mixture.

The electrolytic equipment 10 includes a body or containing means 12 adapted to hold or contain the fused halide salt bath and titanium tetrachloride without substantial adverse effects to the material of which the containing means 12 is constructed. Although a number of different materials are suitable, the containing means 12 is generally formed of a metal, such as steel, nickel and the like. The containing means 12 is internally divided into at least an anode compartment 14 and a deposition cathode compartment 16. The anode compartment 14 and the cathode compartment 16 are spaced apart from each other by a porous metal diaphragm 17. A diaphragm support 15 can optionally be combined with the diaphragm 17 to complement the diaphragm strength during operation of the equipment 10.

The diaphragm substrate is preferably a metal screen, sheet or film with a multiplicity of holes or pores extending therethrough. Such pores can be formed by, for example, drilling, punching, weaving, sintering, and the like. Generally, and preferably, the holes in the substrate are of a substantially uniform size. The diaphragm 17 preferably is a woven wire screen having a U.S. Standard Screen Mesh of about 50 to about 250 and more preferably about 100 to about 200 on which sufficient nickel or cobalt has been deposited by electrolytic or electroless procedures to provide a desired diaphragm coefficient ($C_d$) and flow coefficient ($C_f$). Preferably, the deposited metal consists essentially of either cobalt or nickel. Suitable deposition procedures are those well known in the art adapted to produce a visually dull or rough surface by, for example, using a reduced amount of brighteners in the plating solutions. The diaphragm substrate can be, for example, iron such as steel or stainless steel, but it is desirably a metal, such as cobalt, nickel or an alloy thereof containing at least about 50 weight percent cobalt or nickel, which is resistant to the corrosive environment within the containing means 10 and retains sufficient strength at predetermined operating temperature to act as a diaphragm.

An anode 18 is disposed in the anode compartment 14 and adapted to be at least partially immersed in the molten halide bath during operation of the electrolytic equipment 10. The material of which the anode 18 is formed is resistant to the corrosive effects of the fused halide bath and also to the elemental chlorine formed at the positive charged anode during operation of the cell. Suitable anode materials are, for example, carbon and graphite. A cathode 20 is suitably disposed within the cathode compartment 16 to be at least partially immersed in the fused halide bath during operation of the electrolytic equipment 10. The deposition cathode 20 is a material such as carbon or a metal as plain carbon steel, titanium and the like onto which metallic titanium can be deposited or plated and subsequently recovered.

The cathode chamber 16 also includes a means (not shown) suitable to heat and to maintain the contents of the equipment 10 at a desired temperature, by heating or cooling, and a feed means 22 adapted to provide a titanium containing feed material to the fused halide bath during operation of the equipment 10. In operation, titanium tetrachloride is passed from a source means 24 through a conduit 26 into the feed means 22 where the titanium tetrachloride passes through a plurality of openings or holes 28, defined by the feed means 22, into the molten halide bath in the cathode compartment 16.

The containing means 12 is fitted with closures 30, 30*a* and 30*b* to provide access to the anode 18, the cathode 20 and the feed means 22. The closures 30, 30*a* and 30*b* are preferably suitably removably attached to the containing means 12 to afford employment of a controlled atmosphere within the containing means 12 and prevent a sufficient amount of the ambient atmosphere, especially nitrogen, oxygen, carbon dioxide and water vapor, from entering into the containing means 12 during operation to substantially reduce the efficiency of the process. During operation, the atmosphere within the electrolytic cell 10 is controlled and maintained to limit the atmospheric gases to low predetermined amounts. The presence of substantial amounts of oxygen, especially approaching that normally present in the ambient air, is operable, but it reduces the cell efficiency, operating life of the cell and quality of the titanium product. Consequently, it is preferred that oxygen and other reactive gases be substantially entirely excluded from the compartments 14 and 16. The closure 30*a* is adapted to exclude oxygen and to provide a means to remove the metallic titanium from the cathode compartment 16 after solid, elemental titanium has been plated onto the deposition cathode 20.

Gaseous chlorine formed at the anode 18 flows to a condenser or chlorine container (not shown) from the anode compartment 14 through a chlorine removal means or pipe 32.

An electrical supply means, such as a generator or rectifier 34, is adapted to provide sufficient electrical energy to the equipment 10 to reduce titanium ions with a valence of +4 to a lower valence state, deposit metallic titanium onto the negative charged deposition cathode 20 and to release elemental chlorine at the positive charged anode 18. The anode 18, deposition cathode 20, feed means 22 and the diaphragm 17 are electrically insulated from the containing means 12. Furthermore, the diaphragm 17 is electrically insulated from electric sources outside of the anode compartment 14 and the cathode compartment 16, such as, the electrical circuitry connected to the anode 18 and the cathode 20. In other words, the diaphragm 17 is positioned in the containing means 12 and operates in the equipment 10 without being electrically wired to impart an electric charge on the diaphragm.

The containing means 12 optionally includes a diaphragm positioning means, such as flanges 36 suitably spaced apart to form passageways or receptacles, into which the diaphragm 17 can be removably positioned. Should it become necessary to replace the diaphragm 17 during operation of the embodiment of FIG. 1, a second diaphragm (not shown) can be juxtaposed to the diaphragm 17 in the unused flanges 36 prior to removal of the diaphragm 17. Optionally, through the use of the flanges 36, more than one diaphragm can simultaneously be employed. Alternatively, the flanges 36 can be used to retain at least one filter means (not shown) in at least the cathode compartment 16 and optionally, the anode compartment 14 to prevent mechanical damage to or physical plugging of the diaphragm 17 with solid matter contained in the catholyte or anolyte.

Figure 2:
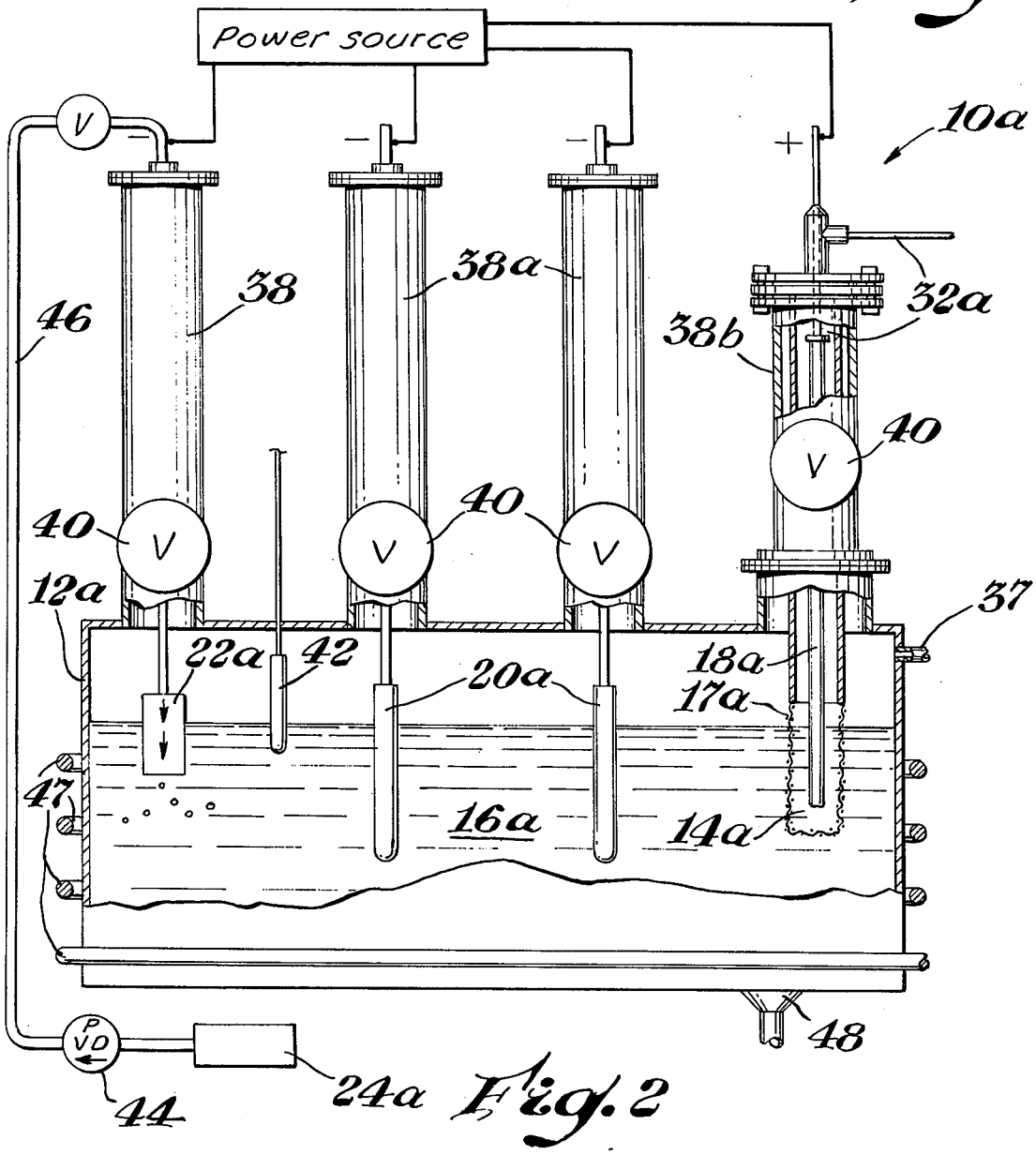
FIG. 2 is a cross-sectional view of another embodiment of the invention.

FIG. 2 is illustrative of a preferred embodiment of an electrolytic cell assembly 10*a* wherein an externally heated and/or cooled containing means 12*a* is adapted to hold a potassium chloride-lithium chloride-titanium di-chloride-titanium tri-chloride containing catholyte in a cathode compartment 16*a* and a lithium chloride-potassium chloride electrolyte in an anode compartment 14*a*. The anode compartment 14*a* is spaced apart from the cathode compartment 16*a* by a porous woven screen diaphragm 17*a* surroundingly positioned in a spaced apart relationship around an anode 18*a*. To prolong the useful life of the diaphragm, the distance between the diaphragm and anode is preferably selected to be at least about ¼ times, and more preferably within the range of from about ¼ to about 1½ times, and even more preferably substantially equal to the anode diameter. Two deposition cathodes 20*a* and a titanium ion feed means or feed cathode 22*a* are disposed in the cathode compartment 16*a* in a spaced apart relationship to each other and to the diaphragm 17*a*. The containing means 12*a* is also electrically insulated from the diaphragm 17*a* and the various electrically charged components of the assembly 10*a*.

The containing means 12*a* is preferably adapted to be substantially gas tight to prevent entrance of atmospheric gases into the anode compartment 14*a* and/or the cathode compartment 16*a*. To facilitate maintaining the cell assembly 10*a* in a controlled, substantially inert atmosphere, a protective gas inlet means 37 is provided to permit entrance of a protective gas into the enclosed containing means 12*a*. The controlled atmosphere is a gas, such as argon or helium, which is substantially inert to the electrolyte and the titanium at the normal operating temperature. When a lithium chloride-potassium chloride electrolyte is used in combination with titanium tetrachloride, the operating temperature is generally controlled within the range of from the eutectic temperature of the salt mixture (about 348° C.) to about 650° C. and preferably from about 475° to about 575° C. Naturally, the operating temperature will vary according to the melting point, or range, of the specific electrolyte employed.

To afford removing the anode 18*a*, the deposition cathodes 20*a* and the feed cathode 22*a* for example, replacement or examination, it is preferred that gas tight chambers, such as air locks 38, 38*a* and 38*b*, be provided to permit removal of such cathodes and/or anode without substantial contamination of the atmosphere within the anode compartment 14*a* or the cathode compartment 16*a* with reactive atmospheric gases. A means, such as valves 40, suited to seal the anode compartment 14*a* and the cathode compartment 16*a* from the atmosphere exterior thereto are provided to prevent reactive gases from entering into the containing means 12*a* and contaminating the atmosphere therein. The valves 40 are adapted to slidably close and seal the air locks 38, 38*a* and 38*b* when the anode, cathodes or diaphragms are removed from or inserted into the containing means 12*a*. Operation of such valves and air locks are known to those skilled in the art.

A means 32*a* to remove the gaseous chlorine produced is at least partially disposed within the anode air lock 38*b*. Deposition cathode air locks 38*a* can be employed to remove metallic titanium from the cathode compartment 16*a*.

A valence electrode 42 is adapted to be at least partially immersed in the fused halide electrolyte to determine the average valence of the titanium ions within such electrolyte during operation of the cell assembly 10*a*. The valence electrode 42 can be adapted to be connected with a titanium tetrachloride supply source 24*a* and a titanium tetrachloride metering means, such as pump 44, to control or regulate the titanium ion concentration, and thus the average titanium ion valence, within the cathode compartment 16*a*. The metering pump 44 can be adapted to regulatively supply titanium tetrachloride to the feed cathode 22a through conduit or pipe 46 to thereby control the titanium ion concentration at a predetermined level.

Preferably an electrolyte temperature controlling means 47 is provided to maintain the electrolyte within the anode and cathode compartments 14a and 16a at predetermined desired temperatures. The temperature controlling means 47 can either regulatively cool or heat the electrolyte, as required by selected well known means, such as air, electricity, gas, oil and the like.

During operation of the cell assembly 10a, undesirable oxides, nitrides and other solid matter, such as the waste material generally known in the art as sludge, may accumulate within the containing means 12a. Any sludge formed can be readily removed by use of a sludge removal means, such as a conduit and valve assembly 48. The sludge can be removed by either manual or mechanized means without excessive loss of the electrolyte from the cell assembly 10a.

It is necessary that the pores or openings in the diaphragm 17a be large enough to avoid being plugged with, for example, a substantial amount of particulate metallic titanium, titanium oxide or sludge. Furthermore, the pores should be of a sufficiently small area to prevent a substantial quantity of the molten salt bath containing the titanium ions from passing into the anode compartment 14a from the cathode compartment 16a. Simultaneously, the openings are preferably of a size sufficient to permit passage of a sufficient amount of lithium chloride potassium chloride electrolyte from the cathode compartment 16a to the anode compartment 14a to maintain a desired bath level in the anode compartment 14a. A metallic diaphragm with an electrolytically or electrolessly deposited coating layer of, preferably, cobalt on a preferred nickel substrate has been found to meet the above requirements. The plated diaphragm preferably has a $C_d$ of from about 0.1 to about 0.5 and more preferably from about 0.1 to about 0.4 when the $C_f$ is about 0.1 to about 25. The $C_f$ is preferably about 0.1 to about 8 and more preferably about 0.2 to about 1.

By the use of the described apparatus, and especially the porous diaphragm with predetermined $C_d$ and $C_f$, it has been found that titanium can be produced without requiring adjustment of the diaphragm pore size during electrolysis. Furthermore, since the diaphragm preferably has a screenlike metal substrate with an adherent metal coating thereon, it can be readily stored prior to use and is more resistant to mechanical failure than are diaphragms containing ceramic materials.

Figure 3:
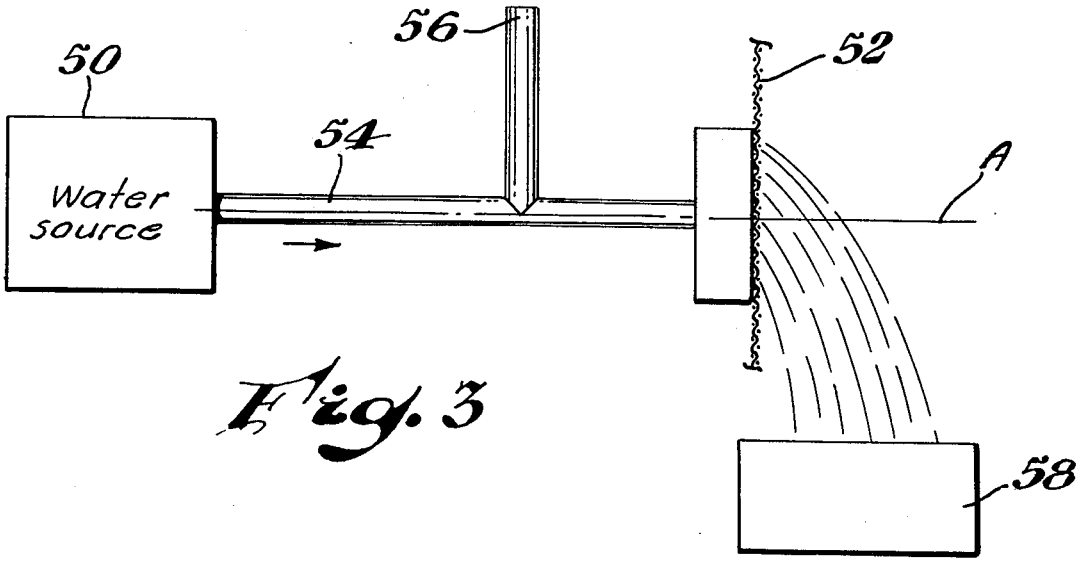
FIG. 3 is a schematic view of a means to measure the water flow rate through a diaphragm.

In FIG. 3 there is schematically depicted a means by which the volumetric flow rate of water through a diaphragm is measured. Water maintained at a temperature of about 75° C. is fed from a source 50 to a diaphragm 52 through a suitable conduit 54. The water flow rate is sufficient to maintain a water level, or head, in an upwardly extending conduit 56 at a distance of 10 inches from axis A of the conduit 54 to the upper surface of the water in the conduit 56. The upper end of the conduit 56 is open to the atmosphere. Maintaining such a head in conduit 56 insures that the average head over the diaphragm 52 tested is about 10 inches of water. The volume of water which flows through a 30 square inch portion of the diaphragm 52 is suitably measured in, for example, container 58. The measured flow rate in liters per minute is used to determine the flow coefficient, $C_f$.

Figure 4:
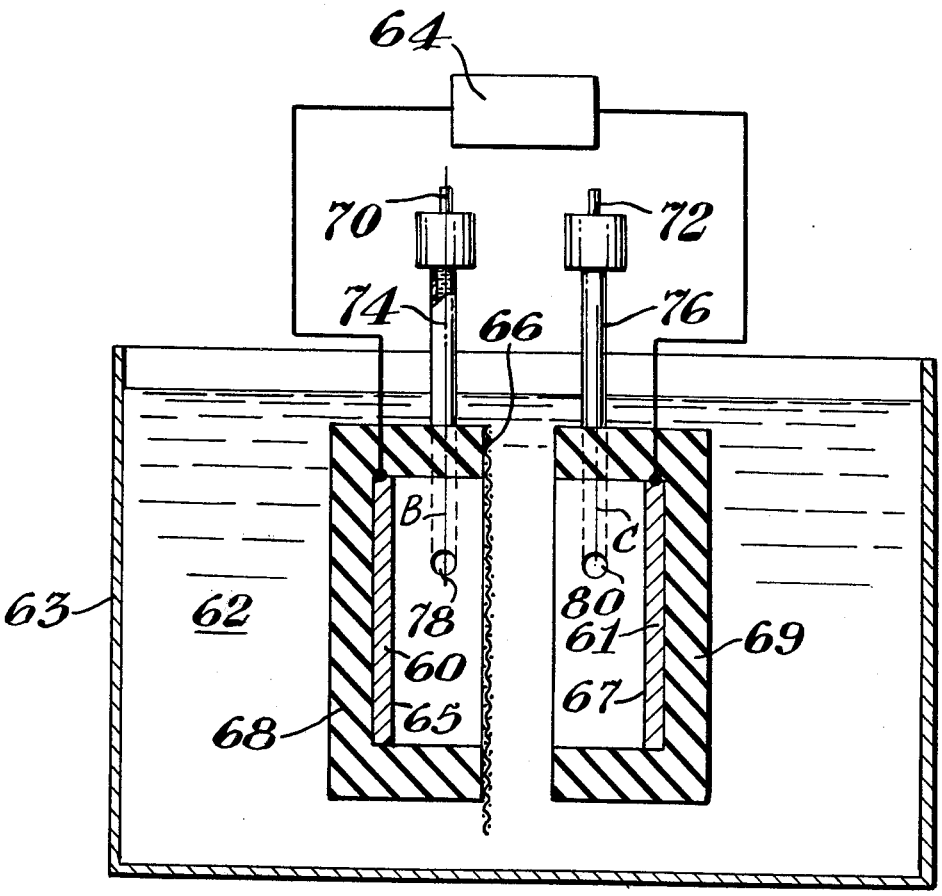
FIG. 4 is a schematic view of an apparatus suitable to measure the diaphragm coefficient.

Referring now to the test apparatus or cell of FIG. 4, $C_d$ is determined by immersing primary electrodes, such as, an anode 60 and a cathode 61, in an electrically conductive solution 62 within a container 63 and connecting such electrodes to a power source 64. Suitable conductive solutions are compatible with the electrodes 60 and 61 and a diaphragm 66 and have a sufficient electrical conductivity to afford an accurate determination of the electrical effect of insertion of the diaphragm 66 into the solution. The electrodes 60 and 61 and the conductive solution are selected to form a cell capable of a reversible electrolytic reaction. Also, the conductivity of the solution is such that insertion of the diaphragm 66 into the solution between the electrodes 60 and 61 will produce an insufficient voltage change between such electrodes to cause the metallic diaphragm 66 to become a bipolar electrode. Silver-silver chloride electrodes have proven to be suitable for use as the electrodes 60 and 61 and are used herein in determining the $C_d$. Likewise, an aqueous 0.1 molar sodium chloride solution is suitable for the described $C_d$ determination and is used herein.

In practice, 1¼ inch by ½ inch by 1/16 inch thick silver-silver chloride electrodes 60 and 61 are suitably positioned within substantially electrically nonconductive retaining members 68 and 69 to space surface 65 of electrode 60 about 1 inch apart from surface 67 of electrode 61. The retaining members 68 and 69 can be constructed from, for example, a methyl acrylate plastic and adapted to direct substantially all of the electrical current passing between the electrodes 60 and 61 through the diaphragm 66 when such diaphragm is abuttingly detachably attached to the retaining members.

The voltage in the solution 62 is measured by using two auxiliary calomel measuring electrodes 70 and 72 connected to the retaining means 68 and 69 of the test cell by salt bridges 74 and 76. Orifices 78 and 80 of salt bridges 74 and 76, respectively, pass through the retaining members 68 and 69 at a position between the primary electrodes 60 and 61. The orifices 78 and 80 are suitably positioned to have a distance of ¾ inch between the centers of such orifices as represented by center lines B and C.

The resistance of the solution 62 is determined by first impressing a sufficient voltage (direct current) between the primary electrodes 60 and 61 to produce a 0.002 ampere current flow between such primary electrodes. This voltage will be less than that voltage necessary to cause decomposition of the electrolyte solution 62. The voltage drop through the ¾ inch distance between the orifices 78 and 80 is measured by the calomel electrodes 70 and 72. The resistance of the solution is determined by dividing the measured voltage between the calomel electrodes 70 and 72 by 0.002 amperes.

The diaphragm 66 is placed in the solution 62 between the primary electrodes 60 and 61 and the salt bridge orifices 78 and 80 to thereby alter the electrical resistance between the electrodes. As aforementioned, the diaphragm 66 is placed in contact with the retaining member 68 in a manner suited to maximize the flow of current through the diaphragm and to minimize the passage of current through any openings at the interface between the surface of the retaining member 68 and the diaphragm 66.

The diaphragm 66 is positioned in the solution 62 between the primary electrodes 60 and 61 and the orifices 78 and 80 to the calomel electrodes 70 and 72 to thereby alter the electrical resistance between the calomel electrodes. At a uniform current of 0.002 amperes, the change in voltage between the calomel electrodes 70 and 72 resulting from insertion of the diaphragm in the test cell, is an amount representative of the porosity and surface characteristics or effectiveness of the diaphragm in the method of the present invention.

The voltage change measured by the calomel electrodes after insertion of the diaphragm between the primary electrodes can readily be converted to an equivalent increase in inches of solution. The equivalent increase in inches of solution is herein referred to as the diaphragm coefficient.

The above described test was used to determine the suitability of an about two inch diameter by about five inch long cylindrical nickel plated, woven nickel screen for use as an electrolytic cell diaphragm. The test apparatus contained a 0.1 molar sodium chloride aqueous electrolyte (reagent grade sodium chloride with a purity of 99.5 weight percent dissolved in distilled water), two 1¼ inch by ½ inch by 1/16 inch thick rectangular silver-silver chloride primary electrodes spaced about 1 inch apart, and two standard calomel electrodes suitably physically connected between the primary electrodes by salt bridges to afford measurement of a voltage impressed across a ¾ inch distance of sodium chloride solution. The silver-silver chloride electrodes were suitably mounted in an organic plastic frame adapted to permit insertion of the screen diaphragm between the electrodes. An electric potential was impressed across the pirmary electrodes and the voltage and direct current measured before and after positioning the screen diaphragm between the electrodes. Tests were carried out at a substantially constant temperature of 20° C. and atmospheric pressure. The voltage of the sodium chloride electrolyte was determined to be 60 millivolts and the current to be 2 milliamps before insertion of the diaphragm. The voltage increased to 75 millivolts after the diaphragm was inserted into the test cell; the current was maintained at two milliamps. The increase in voltage of 15 millivolts was calculated by standard methods to be equivalent to an increase in test cell resistance of 7.5 ohms or 0.188 inch of electrolyte.

EXAMPLES 1-38

Metallic titanium with a purity of about 99.9 weight percent was produced from titanium tetrachloride ($TiCl_4$) in an electrolytic cell similar to that depicted in FIG. 2 of the drawing. The electrolytic equipment included a substantially cylindrically shaped, low carbon steel containing means with an outside diameter of 18 inches and a height of 22 inches. A 1.9 inch diameter by 6.5 inch long substantially cylindrical diaphragm with an enclosed lower end was substantially uniformly positioned around a 0.75 inch diameter by about 18 inches long solid graphite anode. A 6 inch length of the anode was immersed in a molten lithium chloride-potassium chloride bath with approximately a eutectic composition of about 55 weight percent LiCl and about 45 weight percent KCl. The diaphragms were commercially pure nickel screen which had been electrolytically or electrolessly plated with a sufficient amount of cobalt or nickel to provide the desired $C_d$ and $C_f$ (see Tables I and II). Plating was carried out in plating solutions suited to provide a rough and dull or low light reflecting surface. Acceptable, adherent plates were obtained by using solutions of the general composition shown in Table III. To prolong the useful life of the diaphragm, the distance between the diaphragm and anode was selected to be a dimension within the range of from about ¼ to about 1½ times the anode diameter.

A deposition cathode was a commercially available mild steel rod with a diameter of 1.0 inch and a length of 7.5 inches. A feed means or feed cathode was provided to pass gaseous $TiCl_4$ into the molten electrolyte. The feed cathode was a stainless steel pipe with a cylindrical cobalt, iron or nickel electrolytically or electrolessly plated 100 mesh iron or nickel wire screen positioned in a spaced apart, annular relationship around the pipe. The lower portion of the screen was enclosed. The plated feed cathode screen had a $C_d$ of about 0.1 to about 0.6 and a $C_f$ of about 0.2 to about 30. Feed cathodes of this general design are described more fully in a copending U.S. patent application filed Oct. 24, 1974 bearing Ser. No. 517,568, now abandoned, and a continuation-in-part of said application filed Sept. 13, 1976 bearing Ser. No. 722,851. The subject matter of said applications identified Ser. No. 517,568 and Ser. No. 722,851 are incorporated herein by reference.

In operation, liquid $TiCl_4$ was pumped into the feed cathode where it was vaporized and reduced to $TiCl_3$ and $TiCl_2$ as it passed through pores in the feed cathode into the molten catholyte. A sufficient electrical charge was applied to the feed cathode and to the anode and cathode to release chlorine at the anode and to deposit titanium metal on the deposition cathode. The chlorine was continuously removed from the anode compartment through a pipe extending through a cover on the electrolytic cell. Titanium was periodically removed from the cathode by first removing the deposition cathode from the equipment and then scraping the solid deposited titanium sponge from the cathode. The cathode was then replaced in the cell. The atmosphere within the anode and cathode compartments was maintained substantially inert by continuously feeding sufficient gaseous argon into such compartments to maintain a positive pressure therein relative to the atmosphere surrounding the cell.

Tables I and II set forth the specific process parameters together with the titanium current efficiencies and titanium hardnesses obtained in Examples 1-38. As is apparent from Tables I and II, titanium metal with a low hardness and, therefore, a high purity can be efficiently produced by the described process.

In a manner substantially the same as described for Examples 1-38, titanium was satisfactorily produced with diaphragms having a $C_d$ of 0.003 and a $C_f$ of 1.1.

TABLE I

| Ex. | Diaphragm(1) Electrolytic Plate Cobalt | Nickel | $C_d$ | $C_f$ | Valence Electrical Amp. | Volt | Average Ti Ti in in Electrolyte (2) | Soluble lyte Electrolyte (%) (2) | Electro-Ti Current Temp. (° C) (3) | $Cl_2$ Current Efficiency (3,6) (average %) | Hardness Efficiency (3,4) (average %) | Ti Product (3) (average BHN) |
|---|---|---|---|---|---|---|---|---|---|---|---|---|
| 1 | | X | 0.394 | 0.366 | 30 | 3.85 | 2.13 | 5.43 | 530 | 64.0 | 77.5 | 94 |
| 2 | | X(5) | 0.203 | 0.490 | 60 | 6.05 | 2.13 | 5.12 | 530 | — | 67.0 | — |
| 3 | | X | 0.209 | 0.570 | 30 | 3.80 | 2.14 | 5.10 | 525 | 78.5 | 78.5 | 70 |
| 4 | | X | 0.238 | 0.418 | 30 | 3.40 | 2.13 | 6.00 | 530 | 62.3 | 72.8 | 84 |

TABLE I-continued

| Ex. | Diaphragm(1) Electrolytic Plate Cobalt | Nickel | $C_d$ | $C_f$ | Valence Electrical Amp. | Volt | Average Ti Ti in in Electro-lyte (2) | Soluble lyte Electro-lyte (%) (2) | Electro-Ti Current Temp. (° C) (3) | $Cl_2$ Current Efficiency (3,6) (average %) | Hardness Efficiency (3,4) (average %) | Ti Product (3) (average BHN) |
|---|---|---|---|---|---|---|---|---|---|---|---|---|
| 5 | | X | 0.446 | 0.598 | 30 | 6.05 | 2.17 | 5.77 | 530 | 47.0 | 18.0 | 90 |
| 6 | | X(5) | 0.303 | 1.438 | 30 | 6.60 | 2.16 | 4.68 | 525–530 | 49.3 | 70.3 | 113 |
| 7 | | X(5) | 0.333 | 0.677 | 30 | 4.85 | 2.15 | 5.27 | 530 | 62.0 | 69.2 | 87 |
| 8 | X | | 0.325 | 0.676 | 30.6 | 5.00 | 2.24 | 3.00 | 495–515 | 79.9 | 78.8 | 78 |
| 9 | X | | 0.212 | 0.784 | 60 | 5.65 | 2.33 | 2.73 | 450–555 | 81.3 | 84.7 | 70 |
| 10 | X | | 0.248 | 0.771 | 60 | 5.82 | 2.23 | 2.54 | 552 | 76.3 | 84.7 | 66 |
| 11 | X | | 0.403 | 0.660 | — | — | 2.18 | 2.47 | 553 | — | 82.3 | — |
| 12 | X | | 0.232 | 0.240 | 60.6 | 5.45 | 2.21 | 2.37 | 550–558 | 77.2 | 83.4 | 64 |
| 13 | X | | 0.220 | 0.246 | 60.8 | 4.60 | 2.17 | 2.30 | 550–558 | 73.1 | 87.7 | 68 |
| 14 | X | | 0.219 | 0.246 | 60.3 | 5.90 | 2.26 | 2.38 | 520–530 | 64.2 | 87.6 | 96 |
| 15 | X | | 0.230 | 0.244 | 60 | 5.65 | 2.17 | 2.34 | 550 | 77.3 | 81.7 | 63 |
| 16 | X | | 0.228 | 0.246 | 61 | 4.85 | 2.21 | 4.34 | 525–530 | 80.8 | 76.0 | 65 |
| 17 | X | | 0.221 | 0.242 | 66 | 5.07 | 2.22 | 2.88 | 529 | 83.6 | 88.1 | 68 |
| 18 | X | | 0.192 | 0.176 | 60.4 | 6.30 | 2.14 | 2.43 | 529 | 79.8 | 82.9 | 73 |
| 19 | X | | 0.234 | 0.246 | — | — | 2.20 | 3.99 | — | — | 25.9 | — |
| 20 | X | | 0.324 | 0.389 | 60.3 | 5.45 | 2.22 | 3.98 | 490–508 | 71.6 | 63.0 | 74 |
| 21 | X | | 0.277 | 0.392 | 59.7 | 5.65 | 2.25 | 3.84 | 522–530 | 81.0 | 78.5 | 59 |

(See Table II for notes)

TABLE II

| Ex. | Diaphragm(1) Electroless Plate Cobalt | Nickel | $C_d$ | $C_f$ | Electrical Amp. | Volt | Average Ti Valence in Electro-lyte (2) | Soluble Ti in Electro-lyte (%) (2) | Electro-lyte Temp. (° C) (3) | Ti Current Efficiency (3,6 (average %) | $Cl_2$ Current Efficiency (3,4) (average %) | Ti Product Hardness (3) (average BHN) |
|---|---|---|---|---|---|---|---|---|---|---|---|---|
| 22 | | X | 0.302 | 0.458 | 30 | 4.10 | 2.11 | 5.37 | 525–535 | 60.2 | 66.4 | 97 |
| 23 | | X | 0.284 | 0.418 | 30 | 3.95 | 2.14 | 5.11 | 530–552 | 52.1 | 65.3 | 98 |
| 24 | | X | 0.301 | 0.490 | 30 | 3.55 | 2.16 | 4.61 | 547 | 67.5 | 73.5 | 83 |
| 25 | | X | 0.355 | 0.598 | 30 | 3.60 | 2.16 | 4.47 | 530–537 | 76.5 | 62.5 | 83 |
| 26 | | X | 0.283 | 0.418 | 30 | 4.40 | 2.14 | 4.73 | 535 | 86.4 | 27.3 | 88 |
| 27 | X | | 0.197 | 0.721 | 30 | 4.30 | 2.12 | 4.98 | 517–535 | 74.6 | 62.0 | 88 |
| 28 | X | | 0.197 | 0.676 | 66.4 | 5.00 | 2.20 | 2.98 | 502–510 | 77.4 | 64.8 | 65 |
| 29 | X | | 0.163 | 0.771 | 79.7 | 5.50 | 2.20 | 3.50 | 5.27 | 73.6 | 67.2 | 69 |
| 30 | X | | 0.142 | 10.98 | 80.7 | 5.00 | 2.35 | 3.41 | 5525–530 | 76.5 | 77.0 | 90 |
| 31 | X | | 0.156 | 10.54 | 63.1 | 6.00 | 2.24 | 3.80 | 522–530 | 79.3 | 68.0 | 63 |
| 32 | X | | 0.218 | 6.880 | 60 | 5.73 | — | — | 522–529 | — | 59.4 | — |
| 33 | X | | 0.247 | 5.75 | 60 | 6.06 | 2.24 | 3.60 | — | 71.3 | 41.0 | 74 |
| 34 | X | | 0.308 | 0.490 | 60 | 5.81 | 2.17 | 2.56 | 550–555 | 95.7 | 92.6 | 63 |
| 35 | X | | 0.361 | 0.415 | 67.9 | 5.68 | 2.24 | 3.41 | 525 | 77.5 | 54.9 | 69 |
| 36 | X | | 0.271 | 0.435 | 29.9 | 4.68 | 2.15 | 5.56 | 520–532 | 71.1 | 54.9 | 69 |
| 37 | X | | 0.260 | 0.337 | 111.8 | 6.85 | 2.14 | 5.77 | 524–530 | 79.9 | 48.6 | 65 |
| 38 | X | | 0.381 | 0.800 | 72.9 | 4.85 | 2.17 | 3.64 | 480–510 | 77.7 | 76.0 | 63 |

(1) Substrate was 100 mesh wire commercially pure nickel unless otherwise noted (2) Values determined before the electrodes were energized (3) Values determined over the entire useful life of the diaphragm (4) Percent chlorine efficiency $= \frac{\text{total weight in grams of chlorine produced (or sample weight}}{\text{ave. anode current in amperes} \times \text{hours to produce the Cl} \times 1.323 \text{ grams per-amp hour}}$ (5) Substrate was 200 mesh wire screen (6) Percent titanium efficiency $= \frac{\text{total weight in grams of titanium produced (or sample weight)}}{\text{ave. cathode current in amperes} \times \text{hours to produce the Ti} \times \left(\frac{2}{\text{valence}} \times 0.893 \text{ grams per-amp hour}\right)}$ Table III

| Plating Compositions | |
|---|---|
| Electroless Nickel | Grams per liter of final Solution |
| basic nickel carbonate-$4NiCO_3 . 3Ni(OH)_2 . H_2O$ | 10.0 |
| Citric acid - $C_6H_8O_7$ | 5.25 |
| Ammonium bifluoride - $NH_4HF_2$ | 10.0 |
| Sodium hypophosphite - $NaH_2PO_2 . H_2O$ | 20.0 |
| Hydrofluoric acid - 70 volume % HF solution | 6.0 milliliters/liter |
| Ammonium hydroxide 30 volume % $NH_4OH$ | 30.0 milliliters/liter |
| pH - about 6.5 | |
| Electroless Cobalt | |
| Cobalt chloride - $CoCl_2 . 6H_2O$ | 30.0 |
| Sodium citrate - $Na_3C_6H_5O_7 . 2H_2O$ | 35.0 to 50.0 |
| Ammonium chloride - $NH_4Cl$ | 50.0 |
| Sodium hypophosphite - $NaH_2PO_2 . H_2O$ | 20.0 |
| pH - 8 to 9 | |

What is claimed is:

1. A method to produce metallic titanium in an electrolytic cell having an anode, a cathode and a feed means comprising: inserting a foraminous diaphragm coated with a metal resistant to the environment within the cell into the cell to space apart an anode compartment from a cathode compartment, the diaphragm having a diaphragm coefficient of greater than zero to about 0.5 and a flow coefficient within the range of from about 0.1 to about 25; introducing an ionizable titanium compound into a molten salt bath contained in the cathode compartment; and impressing an electromotive force between the anode and the cathode to form a gas at the anode and to deposit metallic titanium on the cathode.

2. The method of claim 1 including introducing titanium tetrachloride into the molten salt bath.

3. The method of claim 2 including removing gaseous chlorine from the anode compartment.

4. The method of claim 1 wherein the molten salt is a mixture of potassium chloride and lithium chloride.

5. The method of claim 1 wherein the molten salt bath is approximately a eutectic mixture of lithium chloride and potassium chloride.

6. The method of claim 1 including maintaining the molten salt at a temperature within the range of from about the melting point of the eutectic composition to about 650° C.

7. The method of claim 1 including maintaining the molten salt at a temperature within the range of from about 475° to about 575° C.

8. The method of claim 1 including inserting a diaphragm with a diaphragm coefficient within the range of from about 0.1 to about 0.4 in the cell.

9. The method of claim 1 including inserting a diaphragm with a flow coefficient within the range of from about 0.1 to about 8 in the cell.

10. The method of claim 10 including inserting a diaphragm with a diaphragm coefficient within the range of from about 0.1 to about 0.4 in the cell.

11. The method of claim 1 including inserting a diaphragm with a flow coefficient within the range of from about 0.2 to about 1 in the cell.

12. The method of claim 11 including positioning a diaphragm with a diaphragm coefficient within the range of from about 0.1 to about 0.4 in the cell.

13. The method of claim 1 wherein the diaphragm substrate is commercially pure nickel.

14. The method of claim 13 wherein the diaphragm is electrically insulated from electric sources outside of the anode and cathode compartments.

15. The method of claim 14 wherein the metal coating is electrolytically deposited and consists essentially of cobalt or nickel.

16. The method of claim 13 wherein the metal coating is electrolessly deposited and consists essentially of cobalt or nickel.

17. The method of claim 13 wherein the metal coating is electrolessly deposited cobalt, the diaphragm coefficient is from about 0.1 to about 0.4 and the flow coefficient is from about 0.1 to about 8.

18. The method of claim 1 wherein the metal coating is electrolytically deposited cobalt.

19. The method of claim 1 wherein the metal coating is electrolytically deposited nickel.

20. The method of claim 1 wherein the metal coating is electrolessly deposited nickel.

21. The method of claim 1 wherein the metal coating is electrolessly deposited cobalt.

22. The method of claim 21 including introducing titanium tetrachloride into the molten salt bath.

23. The method of claim 1 including feeding argon into the electrolytic cell.

24. The method of claim 1 including controlling the atmosphere within the electrolytic cell to minimize contamination of the atmosphere within the cell with reactive gases.

25. The method of claim 1 including controlling the cell atmosphere to substantially entirely exclude oxygen from the atmosphere within the electrolytic cell.

26. The method of claim 1 wherein the diaphragm is electrically insulated from electric sources outside of the anode and cathode compartments.

27. The method of claim 1 wherein the diaphragm is positioned in a spaced apart relationship with the anode and cathode and is electrically insulated from electric sources outside of the anode and cathode compartments.

28. The method of claim 1 wherein the substrate is a screen and the coating is resistant to the corrosive environment within the cell.

29. The method of claim 1 wherein the substrate is a metal selected from the group consisting of iron, cobalt, nickel and alloys containing at least about 50 weight percent of said metals.

30. The method of claim 29 wherein the diaphragm has predetermined diaphragm and flow coefficients and an electrolessly deposited metal coating consisting essentially of cobalt or nickel.

31. The method of claim 1 wherein the diaphragm coefficient is from about 0.1 to about 0.5.

32. The method of claim 1 wherein the metal coating consists essentially of nickel.

33. The method of claim 1 wherein the metal coating consists essentially of cobalt.

34. A method to produce metallic titanium in an electrolytic cell having an anode, a cathode and a feed means comprising: inserting a foraminous diaphragm coated with a metal resistant to the environment within the cell into the cell to space apart an anode compartment from a cathode compartment, the diaphragm having a diaphragm coefficient of greater than zero to about 0.5 and a flow coefficient within the range of from about 0.1 to about 25 in the cell to space apart an anode compartment from a cathode compartment, the diaphragm coefficient being represented by the formula:

$$\frac{V_{d+s}/I_{d+s} - V_s/I_s}{V_s/I_s} \times 0.75$$

$V_s$ = voltage in volts in an aqueous 0.1 molar sodium chloride solution as determined by calomel measuring electrodes communicating with the solution by salt bridges with orifices to such salt bridges spaced 0.75 inch apart between silver-silver chloride primary electrodes spaced one inch apart $I_s$ = 0.002 amps $V_{d+s}$ = the voltage in the volts as determined under the same conditions as for $V_s$ with the diaphragm positioned between the measuring electrodes $I_{d+s}$ = 0.002 amps, the flow coefficient is represented by a formula:

$$\sqrt{h/F}$$

where:

$h$ = a pressure head of 10 inches of water at about 75° F. as measured upwardly from the center line of a generally circular diaphragm portion, with a 30 square inch area on a single surface of the diaphragm portion, where a water flow measurement through the diaphragm is obtained and $F$ = the volumetric water flow rate through the diaphragm portion at about 75° F. in liters per minute;

introducing an ionizable titanium compound into a molten salt bath contained in the cathode compartment; and impressing an electromotive force between the anode and the cathode to form a gas at the anode and to deposit metallic titanium on the cathode.

35. A method to produce metallic titanium in an electrolytic cell having an anode, a cathode and a feed means comprising: providing at least one foraminous diaphragm coated with a metal, the diaphragm having a diaphragm coefficient of greater than zero to about 0.5 and a flow coefficient within the range of from about 0.1 to about 25; positioning the diaphragm in the cell to space apart an anode compartment from a cathode compartment; introducing an ionizable titanium compound into a molten salt bath contained in the cathode compartment; impressing an electromotive force between the anode and the cathode to form a gas at the anode and to deposit metallic titanium on the cathode without adjusting the diaphragm pore size during electrolysis.

36. The method of claim 35 wherein the metal coating consists essentially of cobalt or nickel.

37. The method of claim 36 wherein the diaphragm coefficient is from about 0.1 to about 0.5.

* * * * *

UNITED STATES PATENT AND TRADEMARK OFFICE

CERTIFICATE OF CORRECTION

PATENT NO. : 4,118,291

DATED : October 3, 1978

INVENTOR(S) : Paul R. Juckniess et al.

It is certified that error appears in the above-identified patent and that said Letters Patent are hereby corrected as shown below:

In the Abstract, last line, delete "deposite" and insert --deposit--.

Column 1, in the first line of the "Cross Reference to Related Application," insert the word --is-- after "This".

Column 2, insert --where:-- after the first formula.

Column 6, line 50, delete "diaphragms" and insert --diaphragm--.

Column 8, line 37, delete the word "means" and insert --members--.

In Table I, columns 9 and 10 and continuing at the top of the page of columns 11 and 12, the headings over columns 6 through 13 of the Table should be identical to the headings 6 through 13 of Table II in columns 11 and 12.

Table II, columns 11 and 12, under the heading "Electrolyte Temp. (°C)(3)", Example 29, delete"5.27" and insert --527--; In Example 30, delete "5525-530" and insert --525-530--.

In Table III, line 1, under the heading "Electroless Nickel" delete "basic nickel carbonate-$4NiCO_3.3Ni(OH)_2.H_2O$" and insert --basic nickel carbonate-$4NiCO_3.3Ni(OH)_2.4H_2O$

UNITED STATES PATENT AND TRADEMARK OFFICE

CERTIFICATE OF CORRECTION

PATENT NO. : 4,118,291

DATED : October 3, 1978

INVENTOR(S) : Paul R. Juckniess et al.

It is certified that error appears in the above-identified patent and that said Letters Patent are hereby corrected as shown below:

Column 13, in the first line of Claim 12, delete the word "positioning" and insert --inserting--.

Column 14, Claim 34, insert --where:-- after the first formula.

Column 14, Claim 34, line 49, delete the word "the" before the word "volts".

Column 14, Claim 34, line 53, delete the word "a" and insert --the-- before the word "formula".

Signed and Sealed this

*Thirtieth* Day of *January 1979*

[SEAL]

*Attest:*

RUTH C. MASON
*Attesting Officer*

DONALD W. BANNER
*Commissioner of Patents and Trademarks*